US012774545B2

(12) United States Patent
Wang

(10) Patent No.: US 12,774,545 B2
(45) Date of Patent: Oct. 27, 2026

(54) NON-CONTACT SETTING MACHINE FOR HEAT SETTING OF SPIRAL MESH, AND SETTING METHOD

(71) Applicant: LEAD FILTRATION MATERIAL TECHNOLOGY (SUZHOU) CO., LTD., Suzhou City (CN)

(72) Inventor: Yang Wang, Suzhou City (CN)

(73) Assignee: LEAD FILTRATION MATERIAL TECHNOLOGY (SUZHOU) CO., LTD., Suzhou (CN)

( * ) Notice: Subject to any disclaimer, the term of this patent is extended or adjusted under 35 U.S.C. 154(b) by 129 days.

(21) Appl. No.: 18/880,008

(22) PCT Filed: May 12, 2023

(86) PCT No.: PCT/CN2023/093809

§ 371 (c)(1),
(2) Date: Dec. 30, 2024

(87) PCT Pub. No.: WO2024/001552

PCT Pub. Date: Jan. 4, 2024

(65) Prior Publication Data

US 2025/0333891 A1 Oct. 30, 2025

(30) Foreign Application Priority Data

Jun. 30, 2022 (CN) ..... 202210757069.3

(51) Int. Cl.
*D06C 7/02* (2006.01)

(52) U.S. Cl.
CPC ..... *D06C 7/02* (2013.01)

(58) Field of Classification Search
CPC ..... D06F 95/008
See application file for complete search history.

(56) References Cited

U.S. PATENT DOCUMENTS 3,515,174 A 6/1970 Herkenberg

FOREIGN PATENT DOCUMENTS

| | | | |
|---|---|---|---|
| CN | 112831958 | A | 5/2021 |
| CN | 113152022 | A | 7/2021 |
| CN | 114960091 | A | 8/2022 |
| GB | 978704 | A | 12/1964 |

OTHER PUBLICATIONS

Aug. 7, 2023 Search Report issued in International Patent Application No. PCT/CN2023/093809.

*Primary Examiner* — Jason Y Ko
(74) *Attorney, Agent, or Firm* — Oliff PLC

(57) ABSTRACT

A non-contact setting machine for heat setting of a spiral mesh, and a setting method includes a conveying mechanism for driving a spiral mesh to rotate, a heating mechanism for defining a heating area for the spiral mesh to pass through, and a first visual collector and a second visual collector located on inlet and outlet sides of the heating mechanism. A control device receives visual information of the spiral mesh collected by the first and second visual collectors; the conveying and heating mechanisms are separately connected to the control device by lines; the control device controls and adjusts the conveying mechanism rotating speed and/or the spiral mesh surface tension and/or the heating mechanism temperature. The setting machine and method achieve upper- and lower-layer non-contact heat setting of the spiral mesh and can control the shrinkage range of the mesh surface of the spiral mesh, thus avoiding crinkling.

15 Claims, 9 Drawing Sheets

NON-CONTACT SETTING MACHINE FOR HEAT SETTING OF SPIRAL MESH, AND SETTING METHOD

TECHNICAL FIELD

The present invention pertains to the technical field of spiral mesh manufacturing and specifically relates to a non-contact setting machine for heat setting of spiral mesh, and a setting method.

BACKGROUND ART

Spiral meshes are made from polymer monofilaments through multiple processes such as ring winding, netting, splicing, core insertion and setting. Their products are widely used in industrial filtration, environmental protection, food filtration and other industries. Among the processes, heat setting is crucial, which can improve the molecular crystallinity and orientation in the spiral mesh, and eliminate the internal stress of the spiral mesh generated during processing, thereby significantly improving the quality of the spiral mesh. After heat setting treatment, the spiral mesh shows more excellent performance.

Due to the intrinsic features of dry heat shrinkage of polymer monofilaments, a spiral mesh formed by several monofilaments will also shrink after being heated, but if there is no restriction from an external force, the spiral mesh is prone to excessive shrinkage that is not required by the process, and even crinkling of the mesh surface, affecting the quality of the product. In general, a heating roll is used as a heat source for heat setting treatment of the spiral mesh, and the tension and friction provided by the roll surface inhibit excessive shrinkage of the spiral mesh at the location of contacting the roll surface and complete heat setting.

The existing processes all adopt contact heat setting by means of roll surface heating of the heating roll and the heating is uneven on the side of the spiral mesh contacting the roll surface and the side not contacting the roll surface. Especially, for a spiral mesh with a large thickness or a multi-layer structure, the heat penetration ability of the heating roll is even worse. If the upper- and lower-layer heating method (such as infrared plate, electric heating plate or hot bellows) can be used and work together with stentering of a pin stenter in the width direction, the foregoing problem can be solved perfectly. However, due to the structural particularity of the spiral mesh, in the structural schematic view of a spiral mesh as shown in FIG. 1, a connecting core filament 82 arranged in the width direction is connected in series to a plurality of spiral rings 81 arranged at intervals (in fact, two rows of spiral rings 81 are connected), and the same row of spiral rings 81 arranged in parallel are filled with filling core filaments 83 arranged along the width direction. Therefore, it is difficult for the spiral mesh to withstand a large tension restriction in the width direction, so it is impossible to use a pin stenter for forced stentering (which will cause irreversible damage to the spiral mesh surface) and the spiral mesh is prone to excessive shrinkage or crinkling of the mesh surface in the heating area due to no inhibition of an external force. Therefore, the upper- and lower-layer non-contact heating method cannot be applied in the spiral mesh setting process. Hence, it has become an urgent technical problem for technicians in this industry to develop a setting machine and a setting method that can perform upper- and lower-layer non-contact heating of a spiral mesh and control thermal shrinkage.

SUMMARY OF THE INVENTION

An objective of the present invention is to provide a non-contact setting machine for heat setting of spiral mesh, and a setting method to address the problems in the prior art. The setting machine and the setting method can achieve upper- and lower-layer non-contact heat setting of the spiral mesh without damaging the structure of the mesh surface and meanwhile can control the shrinkage of the mesh surface of the spiral mesh to a certain range and prevent crinkling of the mesh surface due to excessive shrinkage.

The objective of the present invention is achieved through the following technical scheme:

A non-contact setting machine for heat setting of spiral mesh, wherein the non-contact setting machine comprises a conveying mechanism capable of driving a spiral mesh to rotate, a heating mechanism capable of defining a heating area for the spiral mesh to pass through, and a first visual collector and a second visual collector which are located on inlet and outlet sides of the heating mechanism and used to collect visual information of the spiral mesh at the corresponding locations. A control device receives visual information of the spiral mesh collected by the first visual collector and the second visual collector and identifies the width, longitudinal line shape and transverse line shape of the spiral mesh at the corresponding locations, the conveying mechanism and the heating mechanism are separately connected to the control device by means of lines, and the control device can control and adjust the rotating speed of the conveying mechanism and/or the mesh surface tension of the spiral mesh and/or the heating temperature of the heating mechanism.

A mesh surface control mechanism is arranged on inlet and outlet sides of the heating mechanism, respectively, and comprises a first roll component located on the inlet side of the heating mechanism and a second roll component located on the outlet side of the heating mechanism. The first visual collector is located in an area between the inlet end of the heating mechanism and a first regulating roll in the first roll component, and the second visual collector is located in an area between the outlet end of the heating mechanism and a second regulating roll in the second roll component.

The first roll component comprises a pair of first guide rolls which are flush and a first regulating roll located between a pair of the first guide rolls; the spiral mesh enters the heating area after contacting and passing through the upper edge of a first guide roll, the lower edge of the first regulating roll and the upper edge of the other first guide roll in sequence along the direction of travel, or the spiral mesh enters the heating area after contacting and passing through the lower edge of a first guide roll, the upper edge of the first regulating roll and the lower edge of the other first guide roll in sequence along the direction of travel; the first regulating roll controlled by the control device can press firmly on the end face of one side of the spiral mesh and move up and down to adjust the mesh surface tension of the spiral mesh.

The second roll component comprises a pair of second guide rolls which are flush and a second regulating roll located between a pair of the second guide rolls; the spiral mesh leaving the heating area contacts and passes through the upper edge of a second guide roll, the lower edge of the second regulating roll and the upper edge of the other second guide roll in sequence along the direction of travel, or the spiral mesh leaving the heating area contacts and passes through the lower edge of a second guide roll, the upper edge of the second regulating roll and the lower edge of the other second guide roll in sequence along the direction of travel; the second regulating roll controlled by the control device can press firmly on the end face of one side of the spiral mesh and move up and down to adjust the mesh surface tension of the spiral mesh.

The conveying mechanism comprises a driving roll capable of driving the spiral mesh to rotate and a tensioning roll capable of moving, and the conveying mechanism 1 can tension the spiral mesh from the inside of the spiral mesh; the driving roll is rotatably connected to a fixing frame and the tensioning roll is rotatably connected to a tensioning frame, the tensioning frame is arranged on a guide rail and can move along the set direction of the guide rail to change the mesh surface tension of the spiral mesh; the driving roll and the tensioning frame are connected to the control device, respectively. The control device can control the rotating speed of the driving roll and the position of the tensioning frame on the guide rail.

The conveying mechanism further comprises a tension monitor arranged on the tensioning frame. The tension monitor can measure the mesh surface tension of the spiral mesh and is connected to a control device in the form of signal to transmit the measured tension value; the control device prestores a tension threshold and is configured to: control the tensioning frame to move backward if the tension value monitored by the tension monitor is smaller than the tension threshold.

The heating mechanism comprises an upper heater and a lower heater arranged opposite to each other up and down, and a heating area for spiral mesh to pass through is defined between the upper heater and the lower heater and extends along the width direction of the spiral mesh.

An upper temperature monitor and a lower temperature monitor corresponding to the upper heater and lower heater are arranged on the outlet side of the heating area, respectively. The upper temperature monitor and lower temperature monitor both connected to a control device in the form of signal can respectively monitor the upper and lower surface temperatures of the spiral mesh when the spiral mesh comes out from the heating area, and transmit the measured surface temperature values to the control device.

The upper heater and the lower heater are paired infrared heating devices or hot bellows.

A crinkle judging module and a shrinkage judging module are arranged inside the control device, the crinkle judging module can judge based on the visual information collected by the first visual collector and the second visual collector, respectively whether the mesh surface of the spiral mesh is crinkled. Specifically, the control device receives the visual information of the spiral mesh collected by the first visual collector and the second visual collector and transmits the transverse line shape and longitudinal line shape in the visual information to the crinkle judging module, and the crinkle judging module judges based on the transverse line shape and longitudinal line shape whether the mesh surface of the spiral mesh is crinkled; the shrinkage judging module can judge based on the visual information collected by the first visual collector and the second visual collector, respectively whether the mesh surface of the spiral mesh shrinks excessively; specifically, the control device receives the visual information of the spiral mesh collected by the first visual collector and the second visual collector and transmits the width information in the visual information to the crinkle judging module, and the shrinkage judging module judges based on the width of the rear mesh surface of the spiral mesh on the inlet side of the heating mechanism and based on the comparison between the width of the front mesh surface of the spiral mesh on the outlet side of the heating mechanism and the initial width of the mesh surface of the spiral mesh before heating whether the mesh surface of the spiral mesh shrinks excessively.

The control device is connected to a production management system in the form of signal by means of an intelligent port, and the intelligent port can transmit the operating parameters of the non-contact setting machine to the corresponding production management system.

A setting method for a non-contact setting machine for heat setting of spiral mesh, wherein the non-contact setting machine used by the setting method comprises a driving roll capable of driving a spiral mesh to rotate, a heating mechanism capable of non-contact heating of a spiral mesh, a pair of regulating rolls located on inlet and outlet sides of the heating mechanism, a first visual collector between a regulating roll on the inlet side of the heating mechanism and the inlet end of the heating mechanism, a second visual collector between the other regulating roll on the outlet side of the heating mechanism and the outlet end of the heating mechanism, and a control device. A pair of the regulating rolls both are in contact with the mesh surface of the spiral mesh and can increase or reduce the mesh surface tension of the spiral mesh by moving up and down, the spiral mesh passes through the heating mechanism from back to front, a pair of visual collectors can collect visual information of the spiral mesh at corresponding locations, respectively, the control device can identify the width, longitudinal line shape and transverse line shape of the spiral mesh based on the visual information collected by the visual collectors, and the control device can control the rotating speed of the driving roll, the temperature of the heating mechanism and the positions of the regulating rolls;

The specific steps of the setting method are as follows:

S1. providing a target width shrinkage rate S and a total number N of heating times of the spiral mesh, and setting a setting temperature range $T_n$, wherein the target width shrinkage rate S is a ratio between the width of the mesh surface of the spiral mesh before the spiral mesh completes a whole heat setting process and that after the spiral mesh completes the whole heat setting process; the total number N of heating times is the total number of heating times of the spiral mesh in a whole heat setting process, one heating refers to that one heating process of the spiral mesh is completed within the temperature range $T_n$, n is the number of heating times, $1 \leq n \leq N$; the setting temperature range $T_n$ is the heating temperature range corresponding to the $n^{th}$ heat setting of the spiral mesh;

S2. setting the initial number of heating times n=1, and recording the initial width $W_1$ of the mesh surface of the spiral mesh before heating;

S3. heating the spiral mesh by the heating mechanism and gradually increasing the surface temperature of the spiral mesh to within the setting temperature range $T_n$ of the spiral mesh;

S4. the control device judges whether the mesh surface of the spiral mesh is crinkled, if yes, then go to Step S8, if not, then go to Step S6;

S6. the control device records the width $W_2$ of the rear mesh surface of the spiral mesh on the inlet side of the heating mechanism and judges whether $(W_1-W_2)/W_1$ is in the range of $n*S/N \pm B$, if not, then go to Step S4, if yes, then go to Step S7;

S7. judging whether the number n of heating times reaches the set total number N of heating times, if not, then going to Step S3, if yes, then ending the whole heat setting process;

S8. controlling a pair of regulating rolls to increase the mesh surface tension of the spiral mesh and/or reducing the temperature of the heating mechanism within the setting temperature range $T_n$ and/or reducing the rotating speed of the driving roll, and then going to Step S4.

The process that the control device judges whether the mesh surface of the spiral mesh is crinkled in the Step S4 is that: the control device receives the visual information of the spiral mesh collected by the second visual collector and transmits the transverse line shape and longitudinal line shape in the visual information to the crinkle judging module of the control device. The crinkle judging module judges by the following two methods:

S41. the crinkle judging module identifies whether the transverse line shape of the mesh surface of the spiral mesh is wavy, if yes, then judge that the mesh surface is crinkled and go to Step S8, if not, then go to Step S42;

S42. the crinkle judging module identifies whether the longitudinal line shape of the mesh surface of the spiral mesh is wavy, if yes, then judge that the mesh surface is crinkled and go to Step S8, if not, then go to Step S6;

or,

S41. the crinkle judging module identifies whether the longitudinal line shape of the mesh surface of the spiral mesh is wavy, if yes, then judge that the mesh surface is crinkled and go to Step S8, if not, then go to Step S42;

S42. the crinkle judging module identifies whether the transverse line shape of the mesh surface of the spiral mesh is wavy, if yes, then judge that the mesh surface is crinkled and go to Step S8, if not, then go to Step S6.

The Step S1 further comprises: providing a single shrinkage rate range A, which is the allowable range of the ratio of the difference between the width $W_2$ of the rear mesh surface of the spiral mesh on the inlet side of the heating mechanism and the width $W_3$ of the front mesh surface of the spiral mesh on the outlet side of the heating mechanism to the width $W_2$ of the rear mesh surface in the heat setting process. The smaller the single shrinkage rate range A, the smaller the width shrinkage degree of the spiral mesh after passing through the heating mechanism. The setting method further comprises a Step S5 between Step S4 and Step S6. The Step S5 is used to judge whether the mesh surface shrinkage of the spiral mesh on the front and rear sides of the heating mechanism meets the requirements in the heat setting process, and comprises the following steps:

S51. a control device receives visual information of the spiral mesh collected by the first visual collector and the second visual collector and transmits the width $W_2$ of the rear mesh surface of the spiral mesh on the inlet side of the heating mechanism and the width $W_3$ of the front mesh surface of the spiral mesh on the outlet side of the heating mechanism in the visual information to a shrinkage judging module of the control device;

S52. the shrinkage judging module judges whether $(W_1-W_3)/W_1$ in the $n^{th}$ heat setting process is in the shrinkage rate range n*A of the $n^{th}$ heat setting, if yes, then determine that the mesh surface shrinkage of the spiral mesh meets the expectation; if not, then determine that it does not meet the expectation and needs to be adjusted.

In the Step S52, the shrinkage judging module judges whether $(W_1-W_3)/W_1$ in the $n^{th}$ heat setting process is in the shrinkage rate range n*A of the $n^{th}$ heat setting through the following steps:

S521. the shrinkage judging module judges whether $(W_1-W_3)/W_1$ in the $n^{th}$ heat setting process is smaller than the lower limit of the shrinkage rate range n*A of the $n^{th}$ heat setting, if yes, then go to Step S8, if not, then go to Step S522;

S522. the shrinkage judging module judges whether $(W_1-W_3)/W_1$ in the $n^{th}$ heat setting process is greater than the upper limit of the shrinkage rate range n*A of the $n^{th}$ heat setting, if yes, then go to Step S9, if not, then go to Step S6;

or,

S521. the shrinkage judging module judges whether $(W_1-W_3)/W_1$ in the $n^{th}$ heat setting process is greater than the upper limit of the shrinkage rate range n*A of the $n^{th}$ heat setting, if yes, then go to Step S9, if not, then go to Step S522;

S522. the shrinkage judging module judges whether $(W_1-W_3)/W_1$ in the $n^{th}$ heat setting process is smaller than the lower limit of the shrinkage rate range n*A of the $n^{th}$ heat setting, if yes, then go to Step S8, if not, then go to Step S6;

S9. controlling a pair of regulating rolls to reduce the mesh surface tension of the spiral mesh and/or increasing the temperature of the heating mechanism within the setting temperature range $T_n$ and/or increasing the rotating speed of the driving roll, and then going to Step S4.

When the mesh surface of the spiral mesh is crinkled and/or the shrinkage judging module judges that $(W_1-W_3)/W_1$ in the $n^{th}$ heat setting process is smaller than the lower limit of the shrinkage rate range n*A of the $n^{th}$ heat setting, Step S8 is entered and now the Step S8 selects three regulating methods in turn through the following steps:

S81. controlling the regulating rolls to increase the mesh surface tension of the spiral mesh;

S82. judging whether the transverse line shape of the mesh surface of the spiral mesh is wavy, if yes, then going to Step S83, if not, then going to Step S5;

S83. reducing the heating temperature of the heating mechanism within the setting temperature range $T_n$;

S84. judging whether the longitudinal line shape of the mesh surface of the spiral mesh is wavy, if yes, then going to Step S85, if not, then going to Step S5;

S85. reducing the rotating speed of the driving roll;

S86. judging whether the longitudinal line shape of the mesh surface of the spiral mesh is wavy, if yes, then going back to Step S81, if not, then going to Step S5.

When the shrinkage judging module judges that $(W_1-W_3)/W_1$ in the $n^{th}$ heat setting process is greater than the upper limit of the shrinkage rate range n*A of the $n^{th}$ heat setting, Step S9 is entered and now the Step S9 selects three regulating methods in turn through the following steps:

S91. increasing the rotating speed of the driving roll;

S92. judging whether the transverse line shape of the mesh surface of the spiral mesh is wavy, if yes, then going to Step S93, if not, then going to Step S5;

S93. controlling the regulating rolls to reduce the mesh surface tension of the spiral mesh;

S94. judging whether the longitudinal line shape of the mesh surface of the spiral mesh is wavy, if yes, then going to Step S95, if not, then going to Step S5;

S95. reducing the heating temperature of the heating mechanism within the setting temperature range $T_n$;

S96. judging whether the longitudinal line shape of the mesh surface of the spiral mesh is wavy, if yes, then going back to Step S91, if not, then going to Step S5.

The present invention has the following advantages over the prior art:

The non-contact setting machine provided by the present invention judges whether the shrinkage of the spiral mesh is within a reasonable range by monitoring the width of the mesh surface of the spiral mesh on the rear and front sides of the heating mechanism in real time, judges through visual collectors whether the mesh surface of the spiral mesh is crinkled, and is provided with a subsequent regulating method, thereby controlling the mesh surface situation of the whole heating process; further, in the setting method, by judging the shrinkage degree of the spiral mesh, whether the heating process and the whole heat setting process end or not is determined, which further assures the heat setting effect of the spiral mesh and the quality of the spiral mesh after heat setting; compared with a contact heat setting machine, it can increase thermal penetration efficiency and setting quality of the product.

Figure 1:
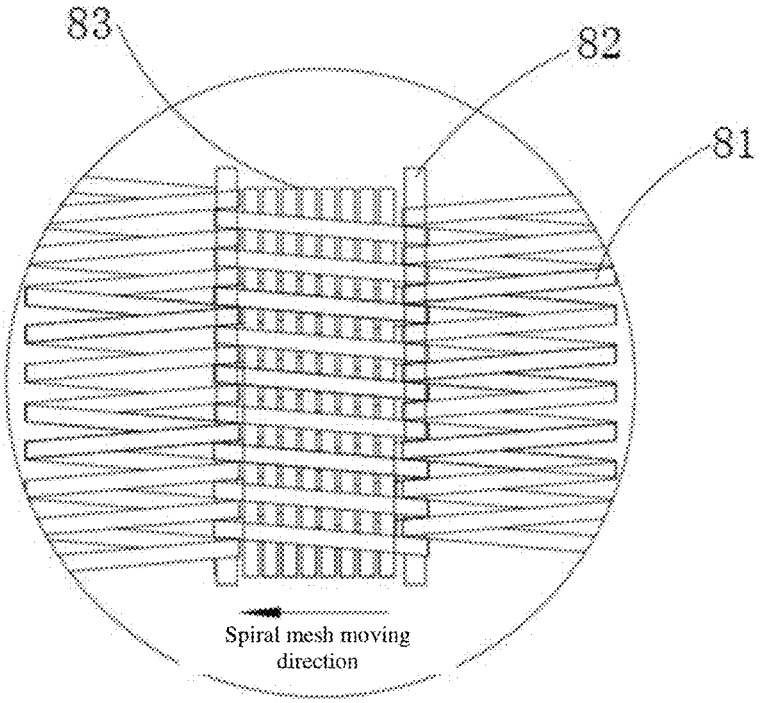
FIG. 1 is a structural schematic view of a spiral mesh.

In which: 100—non-contact setting machine; 1—conveying mechanism; 11—fixing frame; 12—driving roll; 13—tensioning frame; 14—tensioning roll; 15—guide rail; 16—tension monitor; 2—heating mechanism; 21—upper heater; 22—lower heater; 23—upper temperature monitor; 24—lower temperature monitor; 25—heating area; 3—first roll component; 31—first guide roll; 32—first regulating roll; 4—second roll component; 41—second guide roll; 42—second regulating roll; 51—first visual collector; 52—second visual collector; 6—control device; 61—crinkle judging module; 62—shrinkage judging module; 7—intelligent port; 81—spiral ring; 82—connecting core filament; 83—filling core filament.

DETAILED DESCRIPTION

In order to describe in details the technical content, structural features and achieved objectives and effects of the invention, the technical scheme in the embodiments of the present application will be described below in conjunction with the drawings in the embodiments of the present application. Obviously, the described embodiments are only some, not all of the embodiments of the present application. For the purpose of explanation, the description below illustrates many details to provide detailed description of various exemplary embodiments or implementation manners of the present invention. However, the exemplary embodiments may also be implemented without these specific details or in one or more equivalent arrangements. Further, the exemplary embodiments may be different, but need not be exclusive. For example, the specific shape, structure and features of an exemplary embodiment can be used or implemented in another exemplary embodiment without departing from the conception of the invention.

Below, the terms "first" and "second" are intended for description only and cannot be understood to indicate or imply relative importance or implicitly indicate the quantity of the demonstrated technical features. Therefore, the features delimited with "first" or "second" can explicitly or implicitly include one or a plurality of the features. In the description of the present application, unless otherwise specified, "a plurality of" means two or more than two.

Further, in the present application, spatial relative terms such as "below . . . ," "under . . . ," "beneath . . . ," "down," "above . . . ," "over . . . ," "up," "on . . . ," "higher" and "side" (e.g., in "side wall") are intended to describe the relation between an element and another (other) element(s) in the drawings. The spatial relative terms are intended to include different orientations of the device in use, operation and/or manufacturing other than the orientation depicted in the drawing. For example, if the device in the drawing is turned over, then an element described as "below," "under" or "beneath" other elements or features" will then be oriented as "above," "over" or "on" other elements or features. Therefore, an exemplary term "under" can include both orientations of over and under. Further, the device can be otherwise oriented (e.g., rotate by 90 degrees or in other directions) and explained with the descriptors for relative spatial relations used in the text accordingly.

In the present application, the term "width" refers to the width of the mesh surface of the spiral mesh in the left-right direction, and the term "line shape" refers to a two-dimensional curve image of the mesh surface of the spiral mesh on a vertical plane extending in the front-rear direction or on a vertical plane extending in the left-right direction.

Figure 2:
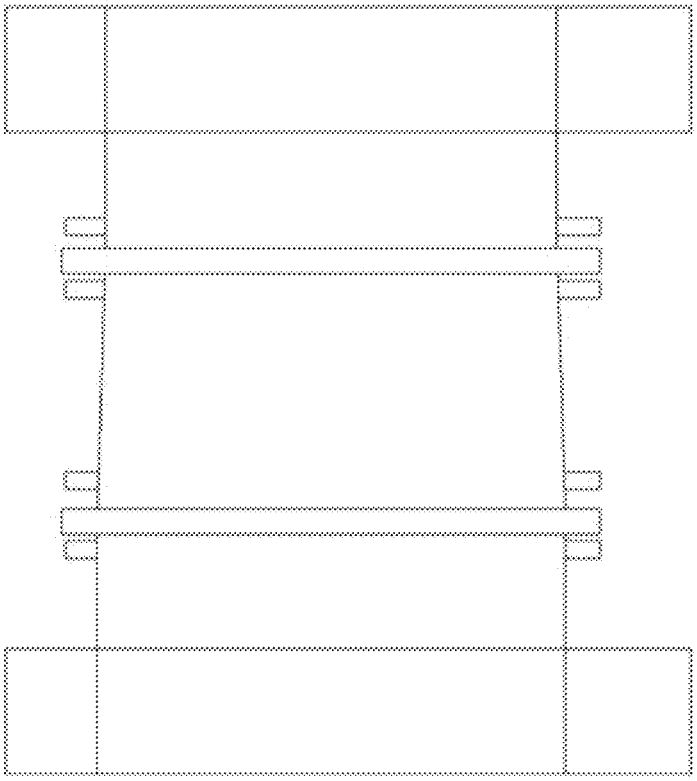
FIG. 2 is a schematic view when the spiral mesh is in a normal state.
Figure 3:
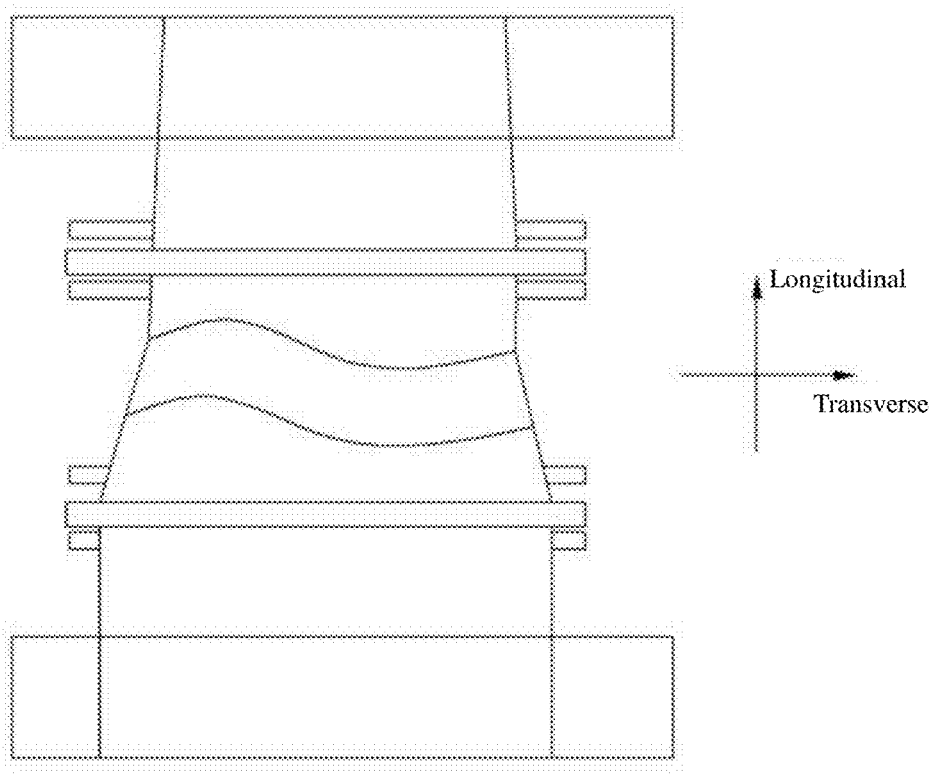
FIG. 3 is a schematic view when the spiral mesh shrinks excessively in the transverse direction.
Figure 4:
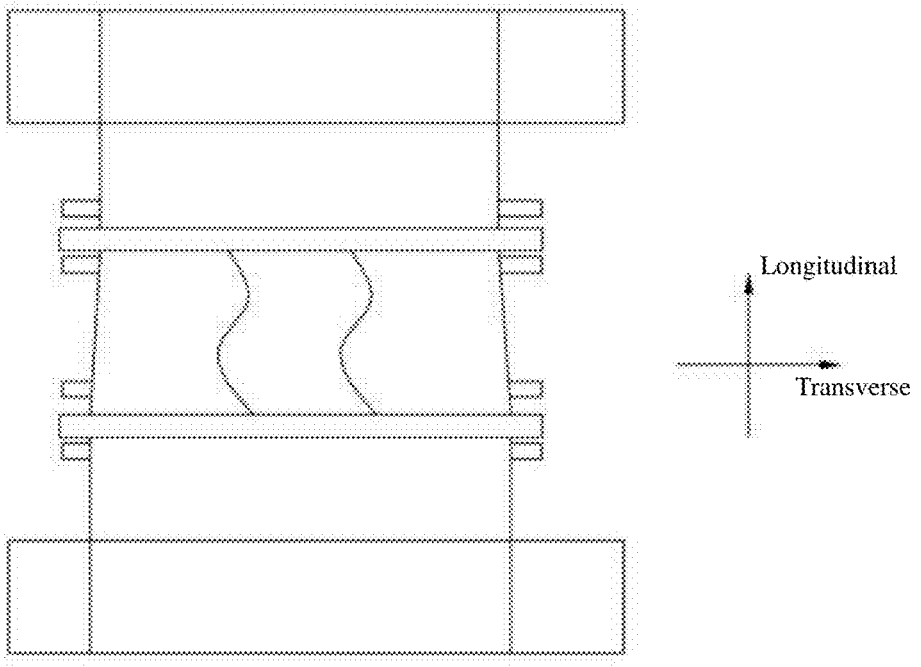
FIG. 4 is a schematic view when the spiral mesh shrinks excessively in the longitudinal direction.
Figure 5:
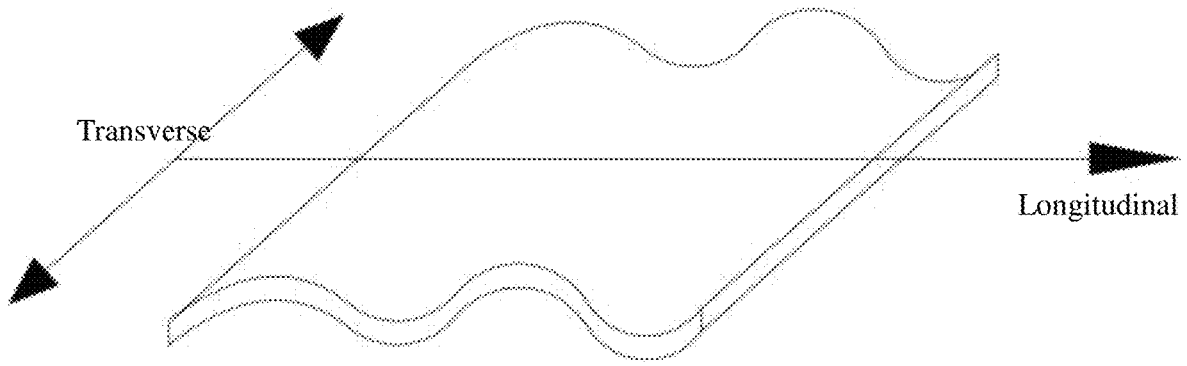
FIG. 5 is a schematic view when the mesh surface of the spiral mesh is crinkled in the longitudinal direction.
Figure 6:
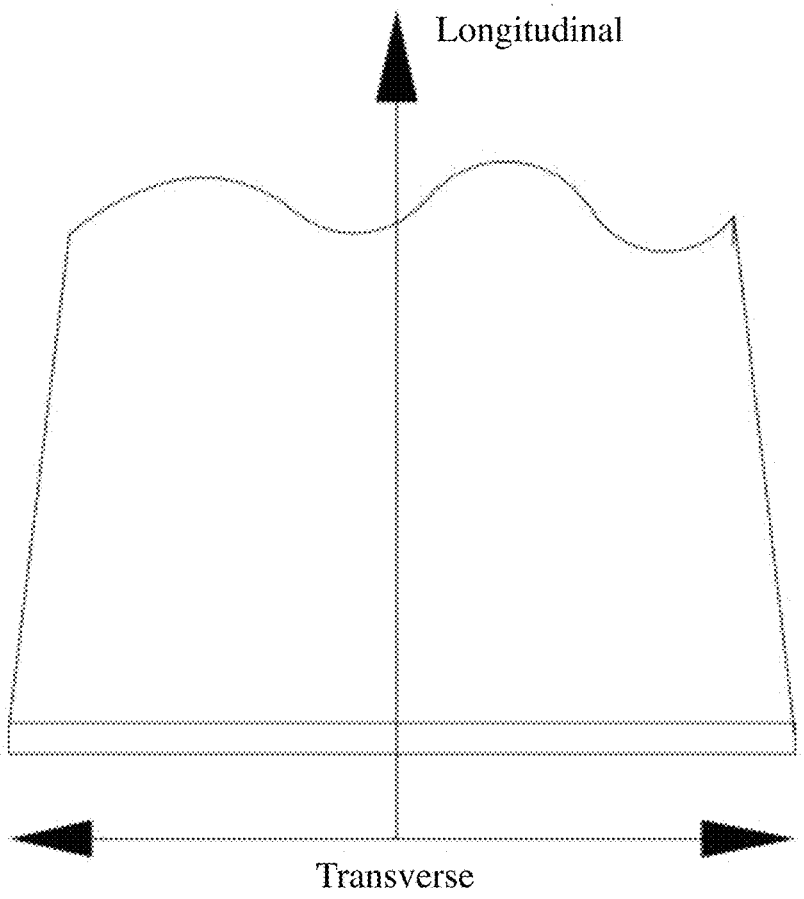
FIG. 6 is a schematic view when the mesh surface of the spiral mesh is crinkled in the transverse direction.

As shown in FIG. 2 to FIG. 6, the normal state of the spiral mesh in the heat setting process is as shown in FIG. 2, but excessive shrinkage (see FIG. 3 and FIG. 4) and crinkling of the mesh surface (see FIG. 5 and FIG. 6) may occur. Excessive shrinkage will make the width of the spiral mesh not meet the process requirements, and the quality of the spiral mesh decline, while the crinkling of the mesh surface will directly lead to the failure to use the spiral mesh. Excessive shrinkage can be judged by monitoring the width ratio of the spiral mesh before and after passing through the heating mechanism 2 (the smaller the ratio, the higher the shrinkage degree, and when it exceeds a certain threshold, it is excessive shrinkage). Crinkling of the mesh surface can be judged through the transverse line shape and longitudinal line shape of the mesh surface of the spiral mesh. If at least one of the line shapes is wavy, it can be judged that the mesh surface shrinks.

Figure 7:
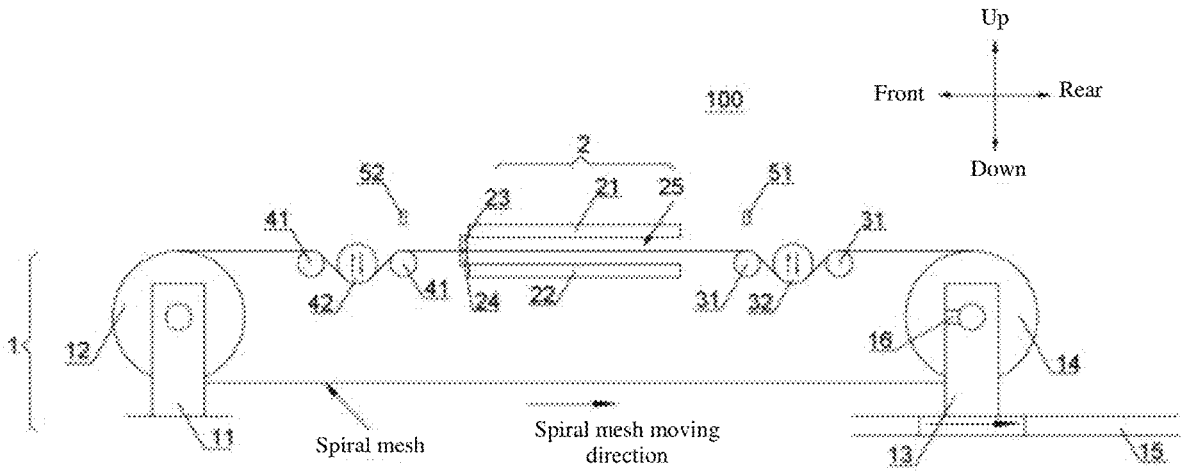
FIG. 7 is a structural side view of an embodiment of a non-contact setting machine for heat setting of spiral mesh provided by the present invention.
Figure 8:
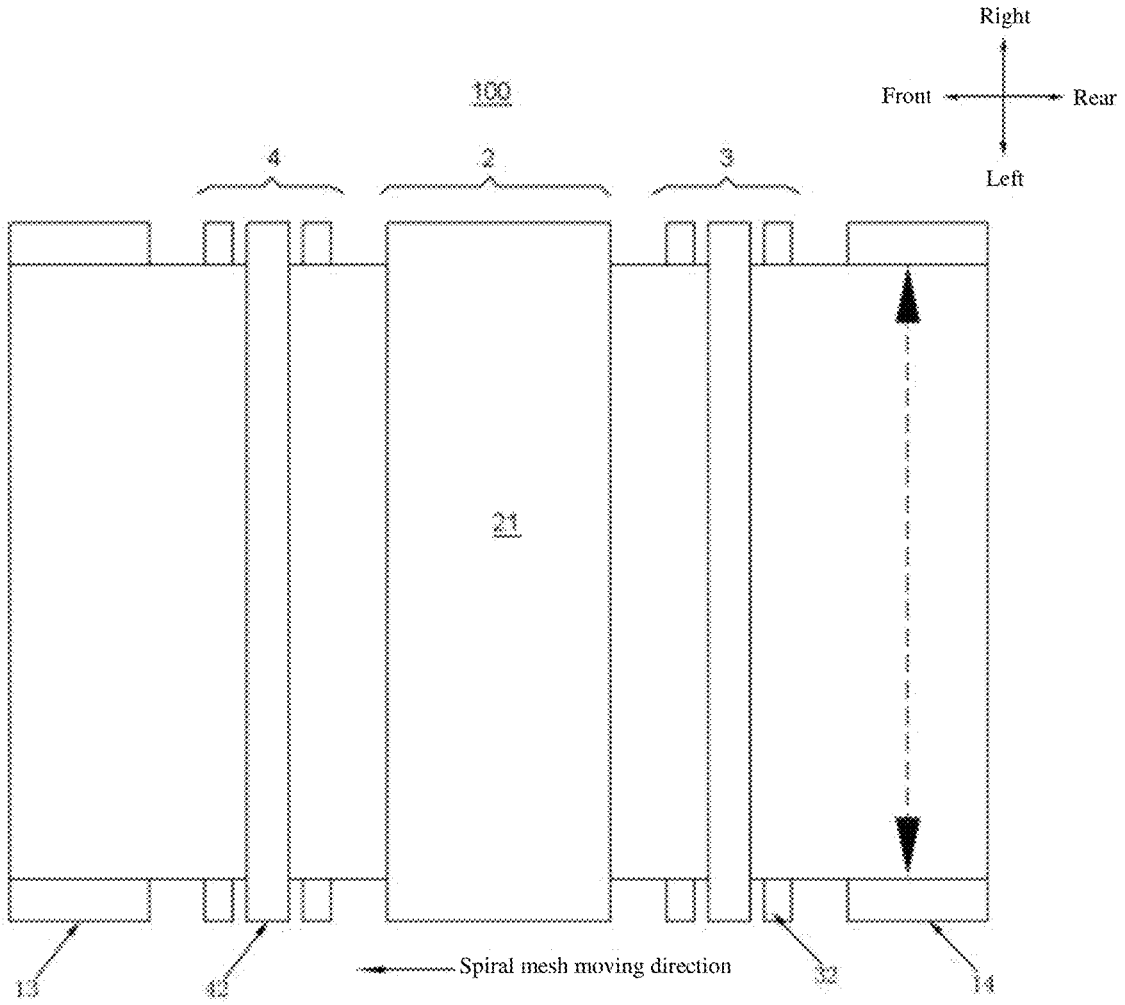
FIG. 8 is a top view of the non-contact setting machine for heat setting of spiral mesh as shown in FIG. 7.
Figure 9:
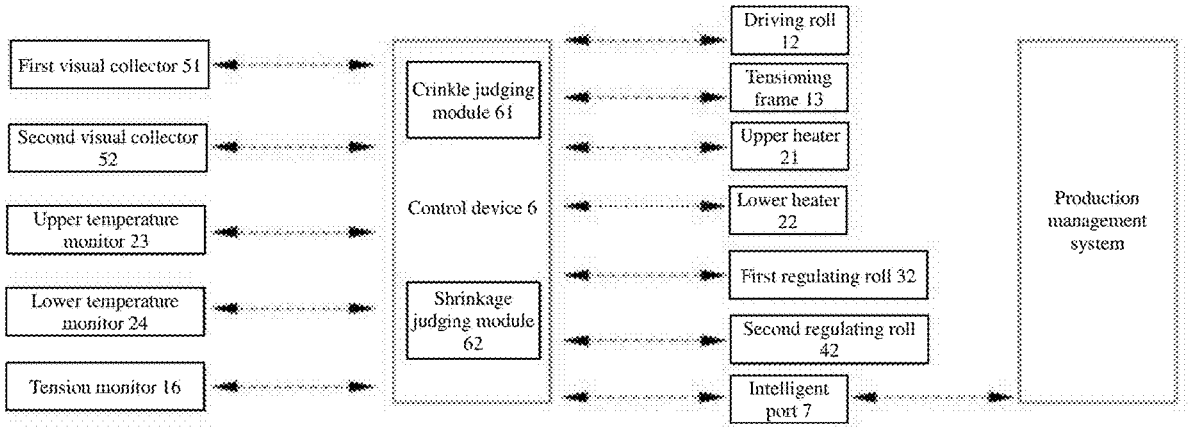
FIG. 9 is a schematic control diagram of the non-contact setting machine for heat setting of spiral mesh provided by the present invention.

FIG. 7 and FIG. 8 show an embodiment-non-contact setting machine 100 provided by the present invention. The non-contact setting machine 100 is capable of heat setting of a spiral mesh, controls the shrinkage of the mesh surface of the spiral mesh within a certain range in the heat setting process and prevents crinkling of the mesh surface (see FIG. 5 and FIG. 6). The non-contact setting machine 100 comprises a conveying mechanism 1 supported on the ground, a heating mechanism 2 for heating a spiral mesh, a mesh surface control mechanism for regulating the width of the spiral mesh, visual collectors for collecting visual information of the spiral mesh on inlet and outlet sides of the heating mechanism 2, and a control device 6 for controlling the operation of the non-contact setting machine 100. As shown in FIG. 9, the control device 6 is connected to a first visual collector 51, a second visual collector 52, an upper temperature monitor 23, a lower temperature monitor 24, a tension monitor 16, a driving roll 12, a tensioning frame 13, an upper heater 21, a lower heater 22, a first regulating roll 32 and a second regulating roll 42 at the same time in the form of signal. The control device 6 can receive the visual information of the spiral mesh collected by the visual collectors and control and adjust the rotating speed of the conveying mechanism 1 and/or the mesh surface tension of the spiral mesh and/or the heating temperature of the heating mechanism 2. The control device 6 is connected to a production management system in the form of signal by means of an intelligent port 7, and the intelligent port 7 is configured to be able to transmit the operating parameters of the non-contact setting machine 100 to the corresponding production management system to realize intelligent management of spiral mesh production. In practical applications, the control device 6 can be a single chip microcomputer or microprocessor pre-installed with programs As shown in FIG. 7 and FIG. 8, the conveying mechanism 1 with a tensioning function comprises a fixing frame 11 supported on the ground, a driving roll 12 rotatably connected to the fixing frame 11, a tensioning frame 13 capable of moving along the front-rear direction, and a tensioning roll 14 rotatably connected to the tensioning frame 13, the tensioning frame 13 is located behind the fixing frame 11 and movably connected to a guide rail 15, and the guide rail 15 extends along the front-rear direction. When the non-contact setting machine 100 works, the driving roll 12 and the tensioning roll 14 are both located on the inner side of the spiral mesh and tension the spiral mesh, the driving roll 12 drives the spiral mesh to rotate, and the tensioning frame 13 changes the mesh surface tension of the spiral mesh by driving the tensioning roll 14 to move back and forth.

As shown in FIG. 7 and FIG. 9, the conveying mechanism 1 further comprises a tension monitor 16 arranged on the tensioning frame 13. The tension monitor 16 can measure the mesh surface tension of the spiral mesh, is connected to a control device 6 in the form of signal and can transmit tension values measured by it to the control device 6. The control device 6 is preset with a tension threshold, can control the tensioning frame 13 to move along the guide rail 15 back and forth and is configured to: control the tensioning frame 14 to move backward when the received tension value is smaller than the tension threshold, thereby tensioning the spiral mesh.

As shown in FIG. 7 and FIG. 8, the heating mechanism 2 comprises an upper heater 21, a lower heater 22 arranged opposite to the upper heater 21, an upper temperature monitor 23 in front of the upper heater 21 and a lower temperature monitor 24 in front of the lower heater 22, the upper heater 21 and the lower heater 22 extend along the left-right direction and define a heating area 25 located between the upper heater 21 and the lower heater 22, and the heating area 25 is configured as: the horizontal central axis of the heating area 25 is flush with the highest point of the driving roll 12 and the heating area 25 allows the spiral mesh to pass through. The upper temperature monitor 23 and the lower temperature monitor 24 can monitor the upper surface temperature and lower surface temperature when the spiral mesh comes out from the heating area 25 and transmit the two measured surface temperatures to the control device 6, and the control device 6 is configured to be able to regulate the output power of the upper heater 21 or the lower heater 22 based on the measured upper surface temperature and lower surface temperature of the spiral mesh. In this embodiment, the upper heater 21 and the lower heater 22 are both infrared heating devices, and the upper heater 21 is configured to be able to move up and down under the control of the control device 6. In other embodiments, the heating mechanism 2 can also be arranged as a pair of hot bellows opposite to each other up and down.

As shown in FIG. 7 and FIG. 8, the mesh surface control mechanism comprises a first roll component 3 adjacent to the rear side of the heating mechanism 2 and a second roll component 4 adjacent to the front side of the heating mechanism 2. The first roll component 3 comprises a pair of first guide rolls 31 arranged opposite to each other front and rear and a first regulating roll 32 located between a pair of the first guide rolls 31, and the first regulating roll 32 and a pair of the first guide rolls 31 are all configured to extend along the left-right direction; the first roll component 3 is configured to be able to allow the spiral mesh to pass through in a shape of V, the highest point of a pair of the first guide rolls 31 is flush with the highest point of the driving roll 12, and the first regulating roll 32 can move up and down relative to a pair of the first guide roll 31 and press down firmly on the upper end of the spiral mesh. The structure and function of the second roll component 4 are same as those of the first roll component 3: the second roll component 4 comprises a pair of second guide rolls 41 arranged opposite to each other front and rear and a second regulating roll 42 located between a pair of the second guide rolls 41, and the second regulating roll 42 and a pair of the second guide rolls 41 are all configured to extend along the left-right direction; the second roll component 4 is configured to be able to allow the spiral mesh to pass through in a shape of V, the highest point of a pair of the second guide rolls 41 is flush with the highest point of the driving roll 12, and the second regulating roll 42 can move up and down relative to a pair of the second guide rolls 41 and press down firmly on the upper end of the spiral mesh.

As shown in FIG. 7, the first visual collector 51 and the second visual collector 52 can respectively monitor and send out the visual information of the spiral mesh on the rear and front sides of the heating mechanism 2. The first visual collector 51 is on the front upper side of the first roll component 3, and the second visual collector 52 is on the rear upper side of the second roll component 4. The control device 6 is configured to be able to identify the rear mesh surface width $W_2$, rear longitudinal line shape and rear transverse line shape of the spiral mesh on the rear side of the heating mechanism 2 based on the visual information sent by the first visual collector 51 and be able to identify the front mesh surface width $W_3$, front longitudinal line shape and front transverse line shape of the spiral mesh on the front side of the heating mechanism 2 based on the visual information sent by the second visual collector 52.

As shown in FIG. 9, the control device 6 is internally provided with a crinkle judging module 61 and a shrinkage judging module 62, the crinkle judging module 61 can identify whether the rear longitudinal line shape, rear transverse line shape, front longitudinal line shape and front transverse line shape are wavy and judge whether the mesh surface of the spiral mesh is crinkled (if wavy, it means that the mesh surface is crinkled). The shrinkage judging module 62 prestores a shrinkage range and is configured to: judge based on the width of the rear mesh surface of the spiral mesh on the inlet side of the heating mechanism 2, and based on the comparison between the width of the front mesh surface of the spiral mesh on the outlet side of the heating mechanism 2 and the initial width of the mesh surface of the spiral mesh before heating whether the mesh surface of the spiral mesh shrinks excessively.

As shown in FIG. 7 to FIG. 9, as the first regulating roll 32 and the second regulating roll 42 both press firmly on the upper end face of the spiral mesh, the control device 6 prestores the $n^{th}$ shrinkage rate range and is configured to: control the first regulating roll 32 and the second regulating roll 42 to face downward if the crinkle judging module 61 judges that the mesh surface of the spiral mesh is crinkled; control the first regulating roll 32 and the second regulating roll 42 to move downward if $(W_1-W_3)/W_1$ of the $n^{th}$ heat setting process is smaller than the lower limit of the shrinkage rate range of the $n^{th}$ heat setting; control the first regulating roll 32 and the second regulating roll 42 to move upward if $(W_1-W_3)/W_1$ of the $n^{th}$ heat setting process is greater than the upper limit of the shrinkage rate range of the $n^{th}$ heat setting.

Below the working principle of the non-contact setting machine 100 provided by this embodiment is described: before start of the non-contact setting machine 100, the first regulating roll 32, the second regulating roll 42 and the upper heater 21 are all in a lifting state, a spiral mesh passes through a tensioning roll 14, a first roll component 3, a heating mechanism 2, a second roll component 4 and a driving roll 12 in turn and its head and tail are connected. Afterwards, the control device 6 controls the first regulating roll 32, the second regulating roll 42 and the upper heater 21 to move to the set positions, and causes the spiral mesh to pass through the first roll component 3 and the second roll component 4 in a shape of V. Afterwards, the tensioning frame 13 is controlled to move backward until the mesh surface tension of the spiral mesh reaches the tension threshold preset by the control device 6. Afterwards, the driving roll 12 drives the spiral mesh to rotate, and the upper heater 21 and the lower heater 22 perform heat setting of the spiral mesh. In the period of heat setting of the spiral mesh, the control device 6 controls the output power of the upper heater 21 and the lower heater 22 based on the temperatures measured by the upper temperature monitor 23 and the lower temperature monitor 24 to ensure the upper and lower surfaces of the spiral mesh are heated uniformly; if the crinkle judging module 61 judges that the mesh surface of the spiral mesh is crinkled, then the control device 6 controls and reduces the heating temperature of the heating mechanism 2 to reduce the mesh surface temperature of the spiral mesh, and/or controls the driving roll 12 to reduce rotating speed, and/or controls the first regulating roll 32 and the second regulating roll 42 to move downward to increase the mesh surface tension of the spiral mesh; if the shrinkage judging module 62 judges that the width ratio is higher than the maximum value of the $n^{th}$ shrinkage rate range, then the control device 6 controls and reduces the heating temperature of the heating mechanism 2 to reduce the mesh surface temperature of the spiral mesh, and/or controls the driving roll 12 to reduce rotating speed, and/or controls the first regulating roll 32 and the second regulating roll 42 to move downward to increase the mesh surface tension of the spiral mesh; if the shrinkage judging module 62 judges that the width ratio is lower than the minimum value of the $n^{th}$ shrinkage rate range, then the control device 6 controls and increases the heating temperature of the heating mechanism 2 to increase the mesh surface temperature of the spiral mesh, and/or controls the driving roll 12 to increase rotating speed, and/or controls the first regulating roll 32 and the second regulating roll 42 to move upward to reduce the mesh surface tension of the spiral mesh.

Figure 14:
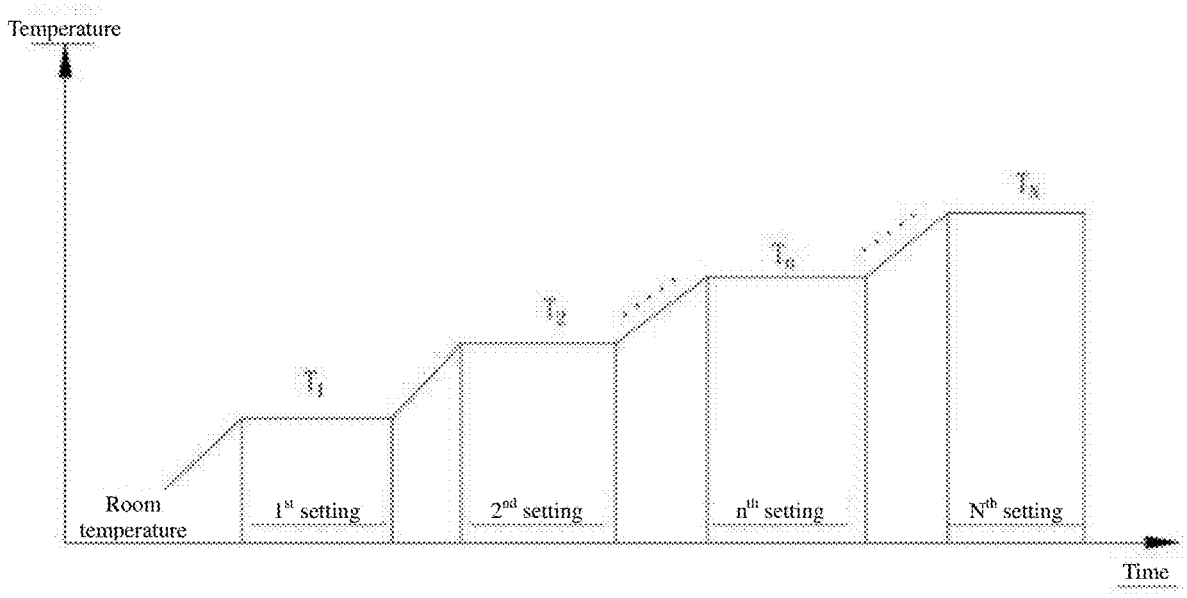
FIG. 14 is a schematic view of heat setting times and corresponding setting temperature range of the non-contact setting machine for heat setting of spiral mesh provided by the present invention.

It should be noted that the temperature of the spiral mesh increases gradually in the period of heat setting, and the specific heating steps are as shown in FIG. 14: 1) The spiral mesh is heated from room temperature to $T_1$ temperature and maintained at $T_1$ temperature to complete the first heat setting and traction process, so that the mesh surface reaches the first shrinkage rate; 2) After the spiral mesh completes setting at $T_1$ temperature, the temperature continues to rise to $T_2$ and is maintained at T2 to complete the second heat setting and traction process, so that the mesh surface reaches the second shrinkage rate; 3) After the spiral mesh completes setting at $T_2$ temperature, the temperature continues to rise to $T_n$ ($1 \le n \le N$) and is maintained at $T_n$ to complete the $n^{th}$ heat setting and traction process, so that the mesh surface reaches the $n^{th}$ shrinkage rate; 4) After the spiral mesh completes setting at $T_n$ temperature, the temperature continues to rise to $T_N$ (N is the set value) and is maintained at $T_N$ to complete the $N^{th}$ heat setting and traction process, so that the mesh surface reaches the $N^{th}$ shrinkage rate and the whole setting process is completed.

Figure 10:
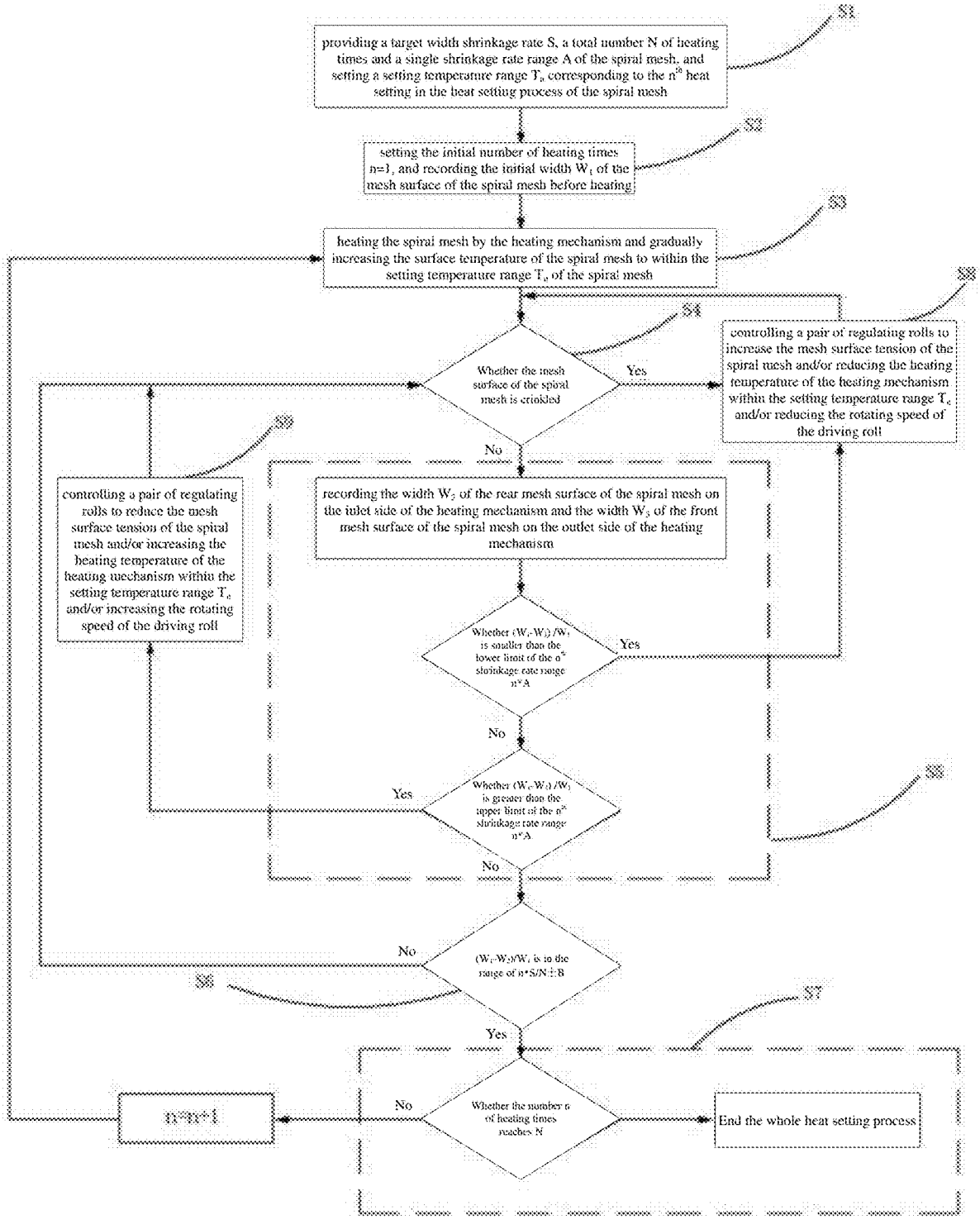
FIG. 10 is a flow diagram of a setting method for a non-contact setting machine for heat setting of spiral mesh provided by the present invention.
Figure 13:
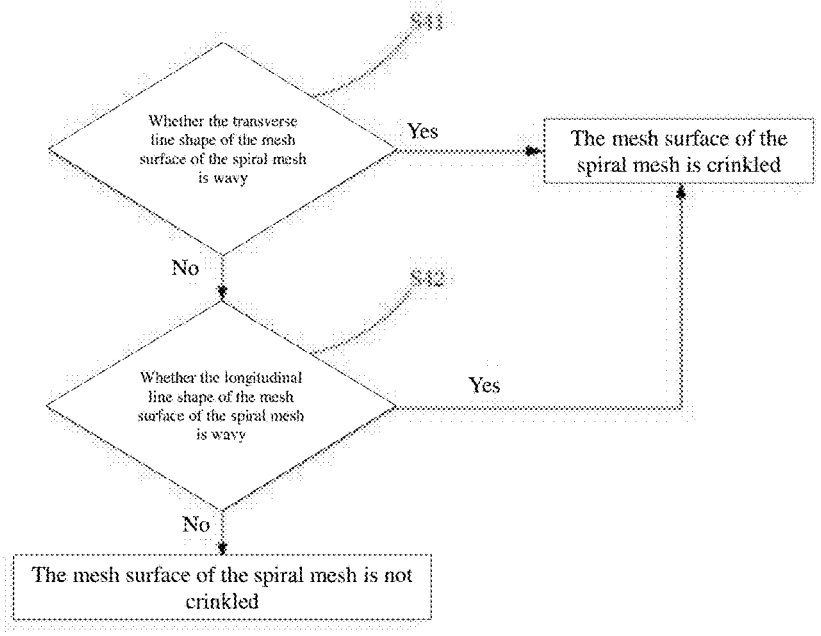
FIG. 13 is a flow chart of a sub-step S4 in the setting method shown in FIG. 10.

FIG. 10 shows another embodiment—spiral mesh setting method provided by the present invention. The setting method can control the non-contact setting machine to automatically heat and set the spiral mesh, maintain the shrinkage of the mesh surface of the spiral mesh within a certain range and prevent crinkling of the mesh surface. A setting method for a non-contact setting machine for heat setting of spiral mesh, wherein the non-contact setting machine 100 used by the setting method comprises a driving roll 12 capable of driving a spiral mesh to rotate, a heating mechanism 2 capable of non-contact heating of a spiral mesh, a pair of regulating rolls located on inlet and outlet sides of the heating mechanism 2, a first visual collector 51 between a regulating roll on the inlet side of the heating mechanism 2 and the inlet end of the heating mechanism 2, a second visual collector between the other regulating roll on the outlet side of the heating mechanism 2 and the outlet end of the heating mechanism 2, and a control device 6. A pair of the regulating rolls both are in contact with the mesh surface of the spiral mesh and can increase or reduce the mesh surface tension of the spiral mesh by moving up and down, the spiral mesh passes through the heating mechanism 2 from back to front, a pair of visual collectors can collect visual information of the spiral mesh on the front and rear sides of the heating mechanism 2, respectively, the control device 6 can identify the width, longitudinal line shape and transverse line shape of the spiral mesh based on the visual information of the spiral mesh collected by the visual collectors, and the control device 6 can control the rotating speed of the driving roll 12, the temperature of the heating mechanism 2 and the positions of the regulating rolls; the specific steps of the setting method are as follows:

S1. providing a target width shrinkage rate S, a total number N of heating times and a single shrinkage rate range A of the spiral mesh, and setting a setting temperature range $T_n$, wherein the target width shrinkage rate S is a ratio between the width of the mesh surface of the spiral mesh before the spiral mesh completes a whole heat setting process and that after the spiral mesh completes the whole heat setting process; the total number N of heating times is the total number of heating times of the spiral mesh in a whole heat setting process, one heating refers to that one heating process of the spiral mesh is completed within the temperature range $T_n$, n is the number of heating times, $1 \leq n \leq N$; the single shrinkage rate range A is the allowable range of the ratio $((W_2-W_3)/W_2)$ of the difference between spiral mesh width values on the two sides of the heating mechanism 2 in the heat setting process; the smaller the single shrinkage rate range A, the smaller the width shrinkage degree of the spiral mesh after passing through the heating mechanism 2; the setting temperature range $T_n$ is the heating temperature range corresponding to the $n^{th}$ heat setting of the spiral mesh; the target width shrinkage rate S, the total number N of heating times, the single shrinkage rate range A and the $n^{th}$ setting temperature range $T_n$ are all determined by the staff according to the specification, model and material of the spiral mesh;

S2. setting the initial number of heating times n=1, and recording the initial width $W_1$ of the mesh surface of the spiral mesh before heating;

S3. heating the spiral mesh by the heating mechanism and gradually increasing the surface temperature of the spiral mesh to within the setting temperature range $T_n$ of the spiral mesh;

S4. the control device judges whether the mesh surface of the spiral mesh is crinkled, if yes, then go to Step S8, if not, then go to Step S6; (if not compared with the $n^{th}$ shrinkage rate range in real time, Step S6 can be entered directly);

The control device 6 in Step S4 receives the visual information of the spiral mesh collected by the second visual collector 52 and transmits the transverse line shape and longitudinal line shape in the visual information to the crinkle judging module 61 of the control device 6, and the crinkle judging module 61 judges whether the mesh surface of the spiral mesh is crinkled through the following steps as shown in FIG. 13:

S41. the crinkle judging module 61 identifies whether the transverse line shape of the mesh surface of the spiral mesh is wavy. If yes, then the mesh surface of the spiral mesh is crinkled;

S42. the crinkle judging module 61 identifies whether the longitudinal line shape of the mesh surface of the spiral mesh is wavy. If yes, then the mesh surface of the spiral mesh is crinkled;

S5. judging whether the mesh surface shrinkage of the spiral mesh on the front and rear sides of the heating mechanism 2 meets the requirements in the heat setting process. The Step S5 comprises the following steps: S51. a control device 6 receives visual information of the spiral mesh collected by the first visual collector 51 and the second visual collector 52 and transmits the width $W_2$ of the rear mesh surface of the spiral mesh on the inlet side of the heating mechanism 2 and the width $W_3$ of the front mesh surface of the spiral mesh on the outlet side of the heating mechanism 2 in the visual information to a shrinkage judging module 62 of the control device 6; S521. the shrinkage judging module 62 judges whether $(W_1-W_3)/W_1$ in the $n^{th}$ heat setting process is smaller than the lower limit of the shrinkage rate range n*A of the $n^{th}$ heat setting, if yes, then go to Step S8, if not, then go to Step S522; S522. the shrinkage judging module 62 judges whether $(W_1-W_3)/W_1$ in the $n^{th}$ heat setting process is greater than the upper limit of the shrinkage rate range n*A of the $n^{th}$ heat setting, if yes, then go to Step S9, if not, then go to Step S6;

S6. a control device 6 receives visual information of the spiral mesh collected by the first visual collector 51 and the second visual collector 52 and transmits the width $W_2$ of the rear mesh surface of the spiral mesh on the inlet side to the shrinkage judging module 62 of the control device 6, the shrinkage judging module 62 judges whether $(W_1-W_2)/W_1$ in the range of n*S/N±B (B is error and is a definite value, for example, B is 0.02%), if not, then go to Step S4, if yes, then go to Step S7;

S7. judging whether the number n of heating times reaches the set total number N of heating times, if not, then going to Step S3, if yes, then ending the whole heat setting process;

S8. controlling a pair of regulating rolls to increase the mesh surface tension of the spiral mesh and/or reducing the heating temperature of the heating mechanism 2 within the setting temperature range $T_n$ and/or reducing the rotating speed of the driving roll 12, and then going to Step S4.

Figure 11:
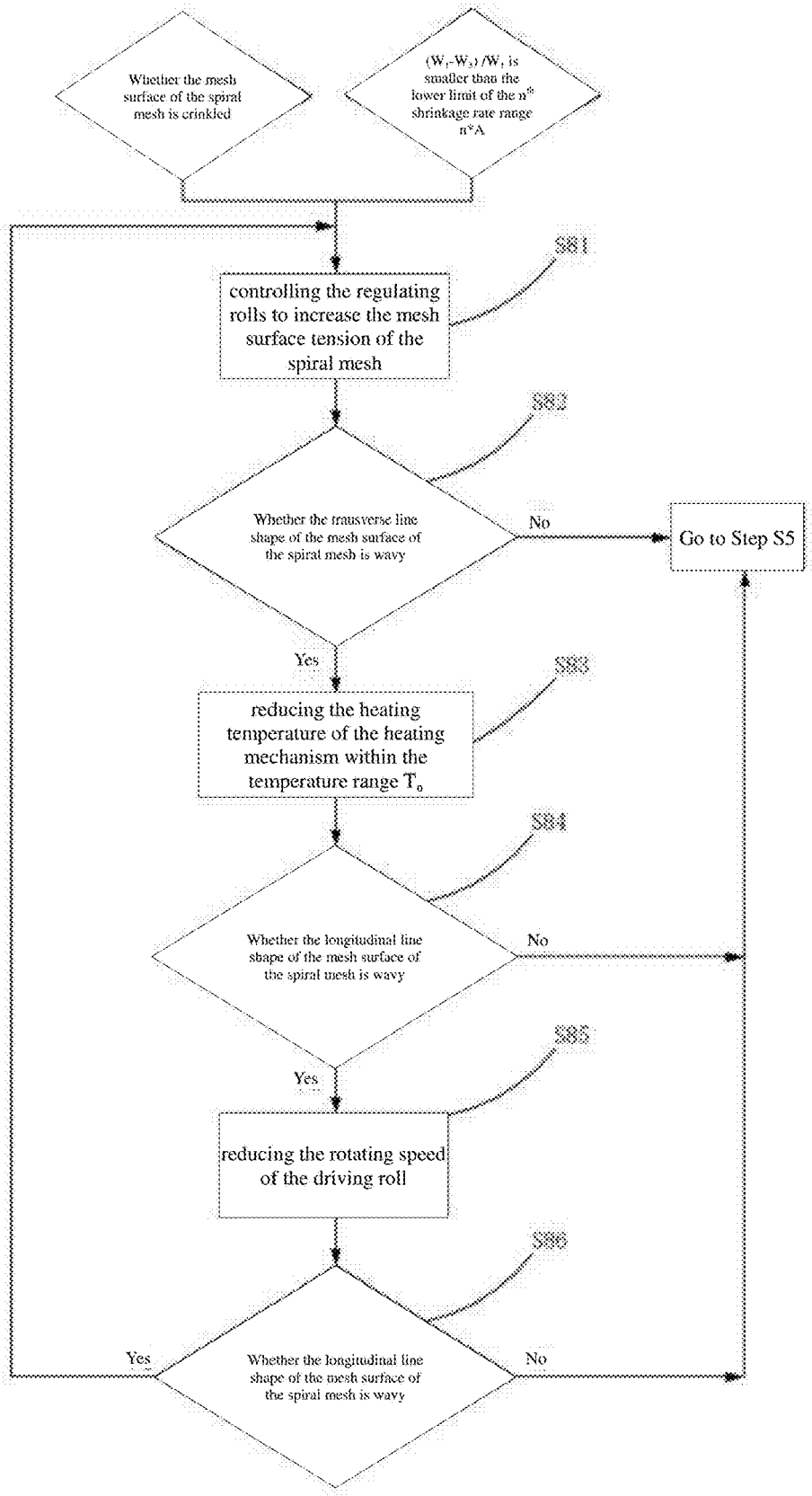
FIG. 11 is a flow chart of a sub-step S8 in the setting method shown in FIG. 10.

This step is a regulating step when the spiral mesh shrinks excessively or is crinkled. By controlling the movement of the regulating rolls, the mesh surface tension of the spiral mesh is increased, thereby opening the spiral mesh by external forces; by controlling the heating mechanism 2 to reduce the heating temperature, the surface temperature of the spiral mesh can be reduced, thereby reducing the shrinking of the spiral mesh or the crinkling of the mesh surface due to heating; by reducing the rotating speed of the driving roll 12, the time of contact between the spiral mesh and the driving roll 12 is increased, thereby increasing the mesh surface tension of the spiral mesh at the driving roll 12; in practical applications, the three regulating methods all can be used, and according to the actual situation (for example, whether the heating temperature reaches the lowest value of the setting temperature range, and whether the regulating rolls reach the movement limit), one of them is selected, or the three regulating methods are selected in turn, respectively;

As shown in FIG. 11: When the mesh surface of the spiral mesh is crinkled and/or the shrinkage judging module 62 judges that $(W_1-W_3)/W_1$ in the $n^{th}$ heat setting process is smaller than the lower limit of the shrinkage rate range n*A of the $n^{th}$ heat setting, Step S8 is entered and now the Step S8 selects the three regulating methods in turn through the following steps:

S81. controlling the regulating rolls to increase the mesh surface tension of the spiral mesh;

S82. judging whether the transverse line shape of the mesh surface of the spiral mesh is wavy, if yes, then going to Step S83, if not, then going to Step S5;

S83. reducing the heating temperature of the heating mechanism 2 within the setting temperature range $T_n$;

S84. judging whether the longitudinal line shape of the mesh surface of the spiral mesh is wavy, if yes, then going to Step S85, if not, then going to Step S5;

S85. reducing the rotating speed of the driving roll 12;

S86. judging whether the longitudinal line shape of the mesh surface of the spiral mesh is wavy, if yes, then going back to Step S81, if not, then going to Step S5.

S9. controlling a pair of regulating rolls to reduce the mesh surface tension of the spiral mesh and/or increasing the heating temperature of the heating mechanism 2 within the setting temperature range $T_n$ and/or increasing the rotating speed of the driving roll 12, and then going to Step S4.

Figure 12:
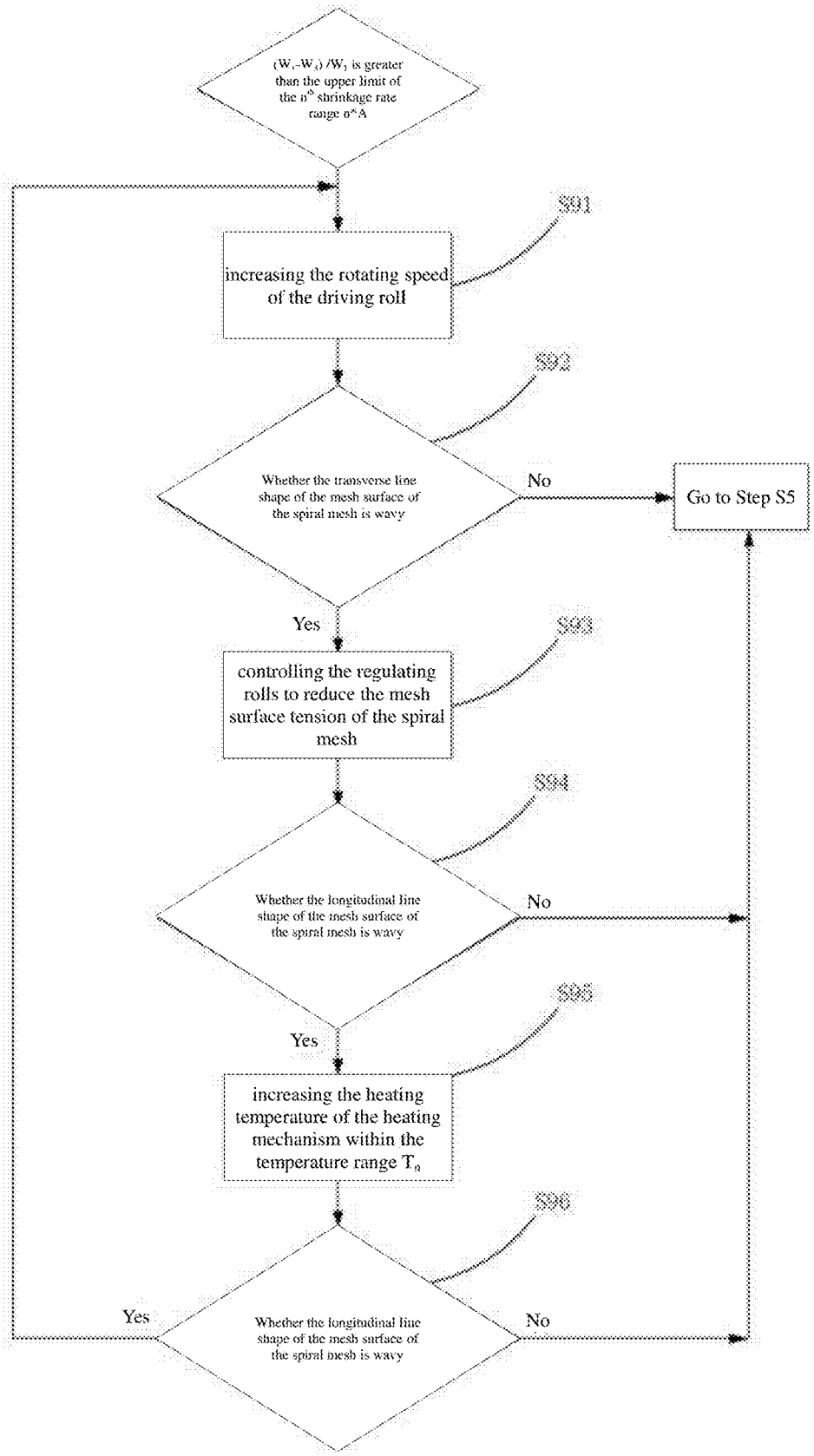
FIG. 12 is a flow chart of a sub-step S9 in the setting method shown in FIG. 10.

This step is a regulating step when the natural shrinkage of the spiral mesh is inhibited by external force. By controlling the movement of the regulating rolls, the mesh surface tension of the spiral mesh is reduced, thereby causing the spiral mesh to shrink naturally; by controlling the heating mechanism 2 to increase the heating temperature, the surface temperature of the spiral mesh can be increased, thereby increasing the shrinkage of the spiral mesh due to heating; by increasing the rotating speed of the driving roll 12, the time of contact between the spiral mesh and the driving roll 12 is reduced, thereby reducing the mesh surface tension of the spiral mesh at the driving roll 12; in practical applications, the three regulating methods all can be used, and according to the actual situation (for example, whether the heating temperature reaches the highest value of the setting temperature range, and whether the regulating rolls reach the movement limit), one of them is selected, or the three regulating methods are selected in turn, respectively;

As shown in FIG. 12: When the shrinkage judging module 62 judges that $(W_1-W_3)/W_1$ in the $n^{th}$ heat setting process is greater than the upper limit of the shrinkage rate range n*A of the $n^{th}$ heat setting, Step S9 is entered and now the Step S9 selects three regulating methods in turn through the following steps:

S91. increasing the rotating speed of the driving roll 12;

S92. judging whether the transverse line shape of the mesh surface of the spiral mesh is wavy, if yes, then going to Step S93, if not, then going to Step S5;

S93. controlling the regulating rolls to reduce the mesh surface tension of the spiral mesh;

S94. judging whether the longitudinal line shape of the mesh surface of the spiral mesh is wavy, if yes, then going to Step S95, if not, then going to Step S5;

S95. reducing the heating temperature of the heating mechanism 2 within the setting temperature range $T_n$;

S96. judging whether the longitudinal line shape of the mesh surface of the spiral mesh is wavy, if yes, then going back to Step S91, if not, then going to Step S5.

The non-contact setting machine provided by the present invention judges whether the shrinkage of the spiral mesh is within a reasonable range by monitoring the width of the mesh surface of the spiral mesh on the rear and front sides of the heating mechanism in real time, judges through visual collectors whether the mesh surface of the spiral mesh is crinkled, and is provided with a subsequent regulating method, thereby controlling the mesh surface situation of the whole heating process; further, in the setting method, by judging the shrinkage degree of the spiral mesh, whether the heating process and the whole heat setting process end or not is determined, which further assures the heat setting effect of the spiral mesh and the quality of the spiral mesh after heat setting.

The above shows and describes the basic principle, main features and advantages of the present invention. Those skilled in the art should understand that the present invention is not limited by the above embodiments and that what is described in the above embodiments and description is only to illustrate the principle of the present invention, and without departing from the spirit and scope of the present invention, the present invention may have various changes and improvements. The scope of protection claimed by the present invention is defined by the attached claims, description and their equivalents. Any changes made according to the technical ideas put forth by the present invention on the basis of the technical schemes shall fall within the scope of protection of the present invention. The technologies not involved by the present invention all can be realized through the prior art.

The invention claimed is:

1. A non-contact setting machine for heat setting of spiral mesh, wherein the non-contact setting machine comprises a conveying mechanism capable of driving a spiral mesh to rotate, a heating mechanism capable of defining a heating area for the spiral mesh to pass through, and a first visual collector and a second visual collector which are located on inlet and outlet sides of the heating mechanism and used to collect visual information of the spiral mesh at the corresponding locations, a control device receives the visual information of the spiral mesh collected by the first visual collector and the second visual collector and identifies the width, longitudinal line shape and transverse line shape of the spiral mesh at the corresponding locations, the conveying mechanism and the heating mechanism are separately connected to the control device by means of lines, and the control device can control and adjust the rotating speed of the conveying mechanism and/or the mesh surface tension of the spiral mesh and/or the heating temperature of the heating mechanism.

2. The non-contact setting machine for heat setting of spiral mesh according to claim 1, wherein a mesh surface control mechanism is arranged on inlet and outlet sides of the heating mechanism, respectively, and comprises a first roll component located on the inlet side of the heating mechanism and a second roll component located on the outlet side of the heating mechanism, the first visual collector is located in an area between the inlet end of the heating mechanism and a first regulating roll in the first roll component, and the second visual collector is located in an area between the outlet end of the heating mechanism and a second regulating roll in the second roll component.

3. The non-contact setting machine for heat setting of spiral mesh according to claim 2, wherein the first roll component comprises a pair of first guide rolls which are flush and a first regulating roll located between a pair of the first guide rolls; the spiral mesh enters the heating area after contacting and passing through the upper edge of a first guide rolls, the lower edge of the first regulating roll and the upper edge of the other first guide roll in sequence along the direction of travel, or the spiral mesh enters the heating area after contacting and passing through the lower edge of a first guide rolls, the upper edge of the first regulating roll and the lower edge of the other first guide roll in sequence along the direction of travel; the first regulating roll controlled by the control device can press firmly on the end face of one side of the spiral mesh and move up and down to adjust the mesh surface tension of the spiral mesh.

4. The non-contact setting machine for heat setting of spiral mesh according to claim 2, wherein the second roll component comprises a pair of second guide rolls which are flush and a second regulating roll located between a pair of the second guide rolls; the spiral mesh leaving the heating area contacts and passes through the upper edge of a second guide rolls, the lower edge of the second regulating roll and the upper edge of the other second guide roll in sequence along the direction of travel, or the spiral mesh leaving the heating area contacts and passes through the lower edge of a second guide rolls, the upper edge of the second regulating roll and the lower edge of the other second guide roll in sequence along the direction of travel; the second regulating roll controlled by the control device can press firmly on the end face of one side of the spiral mesh and move up and down to adjust the mesh surface tension of the spiral mesh.

5. The non-contact setting machine for heat setting of spiral mesh according to claim 1, wherein the conveying mechanism comprises a driving roll capable of driving the spiral mesh to rotate and a tensioning roll capable of moving, the driving roll is rotatably connected to a fixing frame and the tensioning roll is rotatably connected to a tensioning frame, and the tensioning frame is arranged on a guide rail and can move along the set direction of the guide rail to change the mesh surface tension of the spiral mesh; the driving roll and the tensioning frame are connected to the control device, respectively, and the control device can control the rotating speed of the driving roll and the position of the tensioning frame on the guide rail.

6. The non-contact setting machine for heat setting of spiral mesh according to claim 5, wherein the conveying mechanism further comprises a tension monitor arranged on the tensioning frame, the tension monitor can measure the mesh surface tension of the spiral mesh and is connected to a control device in the form of signal to transmit the measured tension value; the control device prestores a tension threshold and is configured to: control the tensioning frame to move backward if the tension value monitored by the tension monitor is smaller than the tension threshold.

7. The non-contact setting machine for heat setting of spiral mesh according to claim 1, wherein the heating mechanism comprises an upper heater and a lower heater arranged opposite to each other up and down, and a heating area for spiral mesh to pass through is defined between the upper heater and the lower heater and extends along the width direction of the spiral mesh; an upper temperature monitor and a lower temperature monitor corresponding to the upper heater and the lower heater are arranged on the outlet side of the heating area, respectively, and the upper temperature monitor and the lower temperature monitor both connected to a control device in the form of signal can respectively monitor the upper and lower surface temperatures of the spiral mesh when the spiral mesh comes out from the heating area, and transmit the measured surface temperature values to the control device.

8. The non-contact setting machine for heat setting of spiral mesh according to claim 1, wherein a crinkle judging module and a shrinkage judging module are arranged inside the control device, the crinkle judging module can judge based on the visual information collected by the first visual collector and the second visual collector, respectively whether the mesh surface of the spiral mesh is crinkled and specifically, the control device receives the visual information of the spiral mesh collected by the first visual collector and the second visual collector and transmits the transverse line shape and longitudinal line shape in the visual information to the crinkle judging module, and the crinkle judging module judges based on the transverse line shape and longitudinal line shape whether the mesh surface of the spiral mesh is crinkled; the shrinkage judging module can judge based on the visual information collected by the first visual collector and the second visual collector, respectively whether the mesh surface of the spiral mesh shrinks excessively; specifically, the control device receives the visual information of the spiral mesh collected by the first visual collector and the second visual collector and transmits the width information in the visual information to the crinkle judging module, and the shrinkage judging module judges based on the width of the rear mesh surface of the spiral mesh on the inlet side of the heating mechanism and based on the comparison between the width of the front mesh surface of the spiral mesh on the outlet side of the heating mechanism and the initial width of the mesh surface of the spiral mesh before heating whether the mesh surface of the spiral mesh shrinks excessively.

9. The non-contact setting machine for heat setting of spiral mesh according to claim 1, wherein the control device is connected to a production management system in the form of signal by means of an intelligent port, and the intelligent port can transmit the operating parameters of the non-contact setting machine to the corresponding production management system.

10. A setting method for a non-contact setting machine for heat setting of spiral mesh, wherein the non-contact setting machine used by the setting method comprises a driving roll capable of driving a spiral mesh to rotate, a heating mechanism capable of non-contact heating of a spiral mesh, a pair of regulating rolls located on inlet and outlet sides of the heating mechanism, a first visual collector between a regulating roll on the inlet side of the heating mechanism and the inlet end of the heating mechanism, a second visual collector between the other regulating roll on the outlet side of the heating mechanism and the outlet end of the heating mechanism, and a control device, a pair of the regulating rolls both are in contact with the mesh surface of the spiral mesh and can increase or reduce the mesh surface tension of the spiral mesh by moving up and down, the spiral mesh passes through the heating mechanism from back to front, a pair of visual collectors can collect visual information of the spiral mesh at corresponding locations, respectively, the control device can identify the width, longitudinal line shape and transverse line shape of the spiral mesh based on the visual information collected by the visual collectors, and the control device can control the rotating speed of the driving roll, the temperature of the heating mechanism and the positions of the regulating rolls;

the specific steps of the setting method are as follows:

S1. providing a target width shrinkage rate S and a total number N of heating times of the spiral mesh, and setting a setting temperature range $T_n$, wherein the target width shrinkage rate S is a ratio between the width of the mesh surface of the spiral mesh before the spiral mesh completes a whole heat setting process and that after the spiral mesh completes the whole heat setting process; the total number N of heating times is the total number of heating times of the spiral mesh in a whole heat setting process, one heating refers to that one heating process of the spiral mesh is completed within the temperature range $T_n$, n is the number of heating times, $1 \leq n \leq N$; the setting temperature range $T_n$ is the heating temperature range corresponding to the $n^{th}$ heat setting of the spiral mesh;

S2. setting the initial number of heating times n=1, and recording the initial width $W_1$ of the mesh surface of the spiral mesh before heating;

S3. heating the spiral mesh by the heating mechanism and gradually increasing the surface temperature of the spiral mesh to within the setting temperature range $T_n$ of the spiral mesh;

S4. the control device judges whether the mesh surface of the spiral mesh is crinkled, if yes, then go to Step S8, if not, then go to Step S6;

S6. the control device records the width $W_2$ of the rear mesh surface of the spiral mesh on the inlet side of the heating mechanism and judges whether $(W_1-W_2)/W_1$ is in the range of n*S/N±B, if not, then go to Step S4, if yes, then go to Step S7;

S7. judging whether the number n of heating times reaches the set total number N of heating times, if not, then going to Step S3, if yes, then ending the whole heat setting process;

S8. controlling a pair of regulating rolls to increase the mesh surface tension of the spiral mesh and/or reducing the heating temperature of the heating mechanism within the setting temperature range $T_n$ and/or reducing the rotating speed of the driving roll, and then going to Step S4.

11. The setting method for a non-contact setting machine for heat setting of spiral mesh according to claim 10, wherein the process that the control device judges whether the mesh surface of the spiral mesh is crinkled in the Step S4 is that: the control device receives the visual information of the spiral mesh collected by the second visual collector and transmits the transverse line shape and longitudinal line shape in the visual information to the crinkle judging module of the control device, and the crinkle judging module judges by the following two methods:

S41. the crinkle judging module identifies whether the transverse line shape of the mesh surface of the spiral mesh is wavy, if yes, then judge that the mesh surface is crinkled and go to Step S8, if not, then go to Step S42;

S42. the crinkle judging module identifies whether the longitudinal line shape of the mesh surface of the spiral mesh is wavy, if yes, then judge that the mesh surface is crinkled and go to Step S8, if not, then go to Step S6;

or,

S41. the crinkle judging module identifies whether the longitudinal line shape of the mesh surface of the spiral mesh is wavy, if yes, then judge that the mesh surface is crinkled and go to Step S8, if not, then go to Step S42;

S42. the crinkle judging module identifies whether the transverse line shape of the mesh surface of the spiral mesh is wavy, if yes, then judge that the mesh surface is crinkled and go to Step S8, if not, then go to Step S6.

12. The setting method for a non-contact setting machine for heat setting of spiral mesh according to claim 10, wherein the Step S1 further comprises: providing a single shrinkage rate range A, which is the allowable range of the ratio of the difference between the width $W_2$ of the rear mesh surface of the spiral mesh on the inlet side of the heating mechanism and the width $W_3$ of the front mesh surface of the spiral mesh on the outlet side of the heating mechanism to the width $W_2$ of the rear mesh surface in the heat setting process, and the smaller the single shrinkage rate range A, the smaller the width shrinkage degree of the spiral mesh after passing through the heating mechanism; the setting method further comprises a Step S5 between Step S4 and Step S6, and the Step S5 is used to judge whether the mesh surface shrinkage of the spiral mesh on the front and rear sides of the heating mechanism meets the requirements in the heat setting process, and comprises the following steps:

S51. a control device receives visual information of the spiral mesh collected by the first visual collector and the second visual collector and transmits the width $W_2$ of the rear mesh surface of the spiral mesh on the inlet side of the heating mechanism and the width $W_3$ of the front mesh surface of the spiral mesh on the outlet side of the heating mechanism in the visual information to a shrinkage judging module of the control device;

S52. the shrinkage judging module judges whether $(W_1-W_3)/W_1$ in the $n^{th}$ heat setting process is in the shrinkage rate range n*A of the $n^{th}$ heat setting, if yes, then determine that the mesh surface shrinkage of the spiral mesh meets the expectation; if not, then determine that it does not meet the expectation and needs to be adjusted.

13. The setting method for a non-contact setting machine for heat setting of spiral mesh according to claim 12, wherein in the Step S52, the shrinkage judging module judges whether $(W_1-W_3)/W_1$ in the $n^{th}$ heat setting process is in the shrinkage rate range n*A of the $n^{th}$ heat setting through the following steps:

S521. the shrinkage judging module judges whether $(W_1-W_3)/W_1$ in the $n^{th}$ heat setting process is smaller than the lower limit of the shrinkage rate range n*A of the $n^{th}$ heat setting, if yes, then go to Step S8, if not, then go to Step S522;

S522. the shrinkage judging module judges whether $(W_1-W_3)/W_1$ in the $n^{th}$ heat setting process is greater than the upper limit of the shrinkage rate range n*A of the $n^{th}$ heat setting, if yes, then go to Step S9, if not, then go to Step S6;

or,

S521. the shrinkage judging module judges whether $(W_1-W_3)/W_1$ in the $n^{th}$ heat setting process is greater than the upper limit of the shrinkage rate range n*A of the $n^{th}$ heat setting, if yes, then go to Step S9, if not, then go to Step S522;

S522. the shrinkage judging module judges whether $(W_1-W_3)/W_1$ in the $n^{th}$ heat setting process is smaller than the lower limit of the shrinkage rate range n*A of the $n^{th}$ heat setting, if yes, then go to Step S8, if not, then go to Step S6;

S9. controlling a pair of regulating rolls to reduce the mesh surface tension of the spiral mesh and/or increasing the heating temperature of the heating mechanism within the setting temperature range $T_n$ and/or increasing the rotating speed of the driving roll, and then going to Step S4.

14. The setting method for a non-contact setting machine for heat setting of spiral mesh according to claim 12, wherein when the mesh surface of the spiral mesh is crinkled and/or the shrinkage judging module judges that $(W_1-W_3)/W_1$ in the $n^{th}$ heat setting process is smaller than the lower limit of the shrinkage rate range n*A of the $n^{th}$ heat setting, Step S8 is entered and now the Step S8 selects three regulating methods in turn through the following steps:

S81. controlling the regulating rolls to increase the mesh surface tension of the spiral mesh;

S82. judging whether the transverse line shape of the mesh surface of the spiral mesh is wavy, if yes, then going to Step S83, if not, then going to Step S5;

S83. reducing the heating temperature of the heating mechanism within the setting temperature range $T_n$;

S84. judging whether the longitudinal line shape of the mesh surface of the spiral mesh is wavy, if yes, then going to Step S85, if not, then going to Step S5;

S85. reducing the rotating speed of the driving roll;

S86. judging whether the longitudinal line shape of the mesh surface of the spiral mesh is wavy, if yes, then going back to Step S81, if not, then going to Step S5.

15. The setting method for a non-contact setting machine for heat setting of spiral mesh according to claim 14, wherein when the shrinkage judging module judges that $(W_1-W_3)/W_1$ in the $n^{th}$ heat setting process is greater than the upper limit of the shrinkage rate range n*A of the $n^{th}$ heat setting, Step S9 is entered and now the Step S9 selects three regulating methods in turn through the following steps:

S91. increasing the rotating speed of the driving roll;

S92. judging whether the transverse line shape of the mesh surface of the spiral mesh is wavy, if yes, then going to Step S93, if not, then going to Step S5;

S93. controlling the regulating rolls to reduce the mesh surface tension of the spiral mesh;

S94. judging whether the longitudinal line shape of the mesh surface of the spiral mesh is wavy, if yes, then going to Step S95, if not, then going to Step S5;

S95. reducing the heating temperature of the heating mechanism within the setting temperature range $T_n$;

S96. judging whether the longitudinal line shape of the mesh surface of the spiral mesh is wavy, if yes, then going back to Step S91, if not, then going to Step S5.

* * * * *